United States Patent [19]

Johnson et al.

[11] 3,999,461

[45] Dec. 28, 1976

[54] MODULAR LIGHTWEIGHT SQUAD AUTOMATIC WEAPON SYSTEM

[75] Inventors: Curtis D. Johnson; Lonnie D. Antwiler, both of Davenport, Iowa; Larry C. McFarland, Silvis, Ill.; Arthur R. Meyer, Melbourne Beach, Fla.; Fred J. Skahill; Doyle L. White, both of Davenport, Iowa; Keith L. Witwer, Bettendorf, Iowa; Richard L. Wulff, Davenport, Iowa

[73] Assignee: The United States of America as represented by the Secretary of the Army, Washington, D.C.

[22] Filed: Sept. 3, 1975

[21] Appl. No.: 610,024

[52] U.S. Cl. ..... 89/191 R; 42/1 S; 42/71 P; 89/33 CA; 89/40 E; 89/148; 89/185; 89/198

[51] Int. Cl.[2] ..... F41D 5/04

[58] Field of Search ..... 89/191, 199

[56] References Cited

UNITED STATES PATENTS 3,009,396 11/1961 Dixon ..... 89/191

FOREIGN PATENTS OR APPLICATIONS 503,251 12/1954 Italy ..... 89/191

*Primary Examiner*—Stephen C. Bentley

*Attorney, Agent, or Firm*—Nathan Edelberg; Harold H. Card, Jr.; Robert O. Richardson

[57] ABSTRACT

A lightweight one man portable automatic gas-operated weapon system for infantry use having symmetrical forces applied to recoiling parts by use of two parallel gas pressure actuated rods acting in unison. An integral sprocket feed system is actuated by the recoiling parts and avoids gross asymmetrical force movements about the weapon's center of gravity resulting from shifting ammunition weight. A dual tube receiver and dual gas system is featured in the weapon. Major weapon subassemblies comprising modules are operatively interrelated to facilitate replacement during field use of the weapon.

11 Claims, 7 Drawing Figures

MODULAR LIGHTWEIGHT SQUAD AUTOMATIC WEAPON SYSTEM

GOVERNMENT RIGHTS

The invention described herein may be manufactured and/or used by or for the Government for governmental purposes without the payment of any royalty thereon.

BACKGROUND OF THE INVENTION

It is a typical characteristic of automatic weapons, such as machine guns, that accuracy is relatively poor in comparison with rifles. This, chiefly, is due to better control of the rifle, involving precise aiming, followed by a single shot, with the bullet leaving the muzzle before peak forces are reached. Also, rifle feed mechanisms are relatively simple and their operation does not impose disruptive forces upon the weapon during each shot. There often are no recoiling parts in a rifle whereby the bolt may remain locked in full breech position until manuably withdrawn after each shot is fired. Since rifle shots are individually aimed and separately fired, control is firm, continuous and accurate.

The operating conditions in full automatic weapons differ considerably from rifles, and combine generally and cumulatively to result in lack of control over the precise direction of firing in regard to each round. The necessity of continuous ammunition feeding during sustained gunfire bursts usually involves use of recoil force to operate the feed mechanism. The excess recoil force beyond that required to actuate the feed system is reacted by a buffer usually having high restitution characteristics.

Restitution refers to the proportion of incoming velocity from an impacting mass which is returned to that mass. Thus, if a steel bolt carrier is impacted against a solid steel buffer plate, most of this movement will be returned to the bolt carrier in the opposite direction. A buffer system which impacts solid steel surfaces against similar surfaces has very high restitution, and consequently high recoil force impulse peaks applied through the gun buttstock to the user. Fully automatic weapons of modern design known in the prior art have a fire rate on the order of 650 to 1000 rounds per minute and apply recoil peak forces of about 500 pounds or more to the gunner through their buttstocks. This force naturally disrupts the holding force applied to the weapon by the user, severely compromising his ability to aim or otherwise control the weapon. This is especially true when recoil forces comprise a series of discrete impulses as in the case of machine guns firing a succession of rounds in each burst. The effect of this disruptive force is amplified when the force movements about the gun are asymmetrical or otherwise unstabilly oriented. Thus, if the principal vectors of the recoil force are angularly or laterally displaced away from the holding force vectors applied by the user of the weapon, such as would tend to rotate the weapon about any of its three principal axes, the resulting kinetic effects in combination will produce an inherently unstable machine gun. The same deficiencies will usually result from asymmetrical forces applied to the gun from any other cause, internal or external. Such cases illustratively include use of single cylinder systems above or below the barrel in a gas operated weapon, ammunition belt weight or pulling force widely displaced from the gun center of gravity, excessive weight of the weapon, or poor adaptation of gun supporting points with respect to body areas of the user primarily involved in supporting the weapon and resisting its recoil.

The lack of accuracy in automatic weapons is generally compensated by their rapid firing feature whereby a screen of bullets is sprayed over an area generally encompassing the target. This type of weapon is particularly effective when used in an infantry rifle squad by forcing the enemy to take cover while the squad is advancing on the enemy position. Although some of the bullets will hit the target, most will miss, depending upon the range and size of the target. Since this results in far less efficient use of ammunition, machine guns and other automatic weapons represent an increased cost over rifles for the sake of multiple hit probabilities, when a wider range of lethality is desired or multiple targets are simultaneously involved.

SUMMARY OF THE INVENTION

The present invention relates to a gas operated fully automatic weapon system having a long recoil, soft cycle of operation. This reduces the rate of fire to less than 500 rounds per minute to improve its controllability and to improve its useful life. Subassemblies such as a dual tube receiver, an integral sprocket feed mechanism, dual gas actuation apparatus and other modular subassemblies may be separately removed from the weapon as individual modules and replaced with other corresponding subassemblies. This provides for immediate unit level maintenance with minimum weapon down time. Field stripping the entire weapon may be done very quickly, on the order of 10 seconds.

Briefly the automatic weapon system of the present invention consists of 10 groups or subassemblies. These are the receiver 24, charging mechansim 28, sight 18, foregrip 14, barrel 12, fire control assembly 20, feed mechanism 30, operating group 26, dust cover 22 and buttstock 16. These combine to provide a weapon system characterized by lightness of weight, relatively fewer parts, simplicity and reliability of operation, relatively slight recoil force, reduced gunfire rate, and improved manual controllability resulting in greater burst fire accuracy in hitting targets. Although described hereinafter in greater detail with reference to the drawings, a brief discussion of these modules now follows.

The receiver consists of twin tubes 128 and 130 (See FIGS. 5 and 6) located and supported by a main end cap 52 and forward tube guide 38. The main end cap functions as the barrel bearing support and to receive the fire control mechanism. The forward tube guide supports the forward end of the barrel 32 and also contains two gas systems that divert some of the gases from the barrel as cartridges are fired. These gases provide a uniform thrust through the cores of the twin tubes to the operating parts for dual uniform gas system operation. These twin tubes straddle the gun axis, passing through its longitudinal center of gravity, resulting in improved controllability. On the upper receiver tube 128 is located the charging mechanism 28 which engages one of the main operating rods 246 in charging the weapon to ready it for firing. A fixed sling point is provided on the forward tube guide. The rear sight 18 is rigidly attached to the main end cap 52 and has an eight position ballistic cam elevation adjustment and transverse windage adjustment.

The foregrip 14 is of sheet metal. Its construction and clamshell configuration permits it to snap over the receiver tubes for assembly to the receiver. It is normally retained on the receiver during use of the weapon but is readily removable when desired. A hinged spring-loaded door provides immediate access for barrel removal and emplacement.

The quick change barrel 32 includes a flash suppressor 37, a gas housing 34 with two gas ports, a non-adjustable front sight blade, retaining ring gas seals, and a three lug barrel extension with locking recess for attachment of the barrel to the main end cap, all as described in greater detail below.

The fire control assembly 20 features a double safety which locks both the trigger and sear system. This fire control assembly is positioned on the longitudinal center of gravity for better control of the weapon in firing. It is also offset laterally to the right to allow for straight line control of recoil in firing in the assault mode. This offset feature also permits the positioning of the magazine on the center of gravity of the weapon.

A sprocket feed mechanism 30 fits over and rotates about the lower receiver rod 130. The main sprocket assembly contains the sprocket 264, cartridge guide spring, anti-rotation and sprocket release mechanisms and maintains the alignment through engagement with the main end cap and its sprocket-lower rod interface. A cam tube assembly rotates about the lower tube and drives the feed mechanism. It contains the drive ratchet 277 and a cycloidal cam slot path 270 which provides for smooth continuous feeding throughout the entire recoil cycle as the cam tube assembly is rotated by longitudinal movement of the main drive pin of the operating group as it moves in the cam slot path. This feed mechanism has about one-fourth the number of parts of conventional feed mechanisms such as the M60 Machine Gun, for example.

The operating group 26 contains dual interchangeable operating rods 244 and 246 attached to the bolt carrier 236, by the main drive pin 168 which also actuates the feed mechanism as it moves longitudinally in the cam path 270 of the cam tube assembly 268. The bolt carrier 236 contains the striker, cocking cam and bolt locking/unlocking cam. The bolt is three lug in design, with a striker mechanism and conventional extraction, rammer and ejector systems. The drive rods, 244, 246 reciprocate within the confines of the receiver tubes 128, 130 where they have operational interfaces with the gas systems and main drive springs 248, 250 while the bolt carrier receives positive guidance through engagement with the exterior of the upper rod and drive pin. The striker mechanism is cocked during recoil and released during the last 0.10 inch of the bolt carrier motion in counterrecoil and imparts a high velocity primer indent, i.e., strikes the cartridge, at levels independent of slide velocity or operational conditions.

The dust cover 22 has no function in the operating group alignment as is typical of conventional receiver elements. The ejection port and ejection port dust cover assembly 96 is contained on the cover.

The buttstock assembly 16 houses a hydropneumatic buffer and contains a folding buttplate, rear sling swivel and storage space for cleaning equipment and spare parts. The assembly attaches to the weapon through engagement of the receiver tubes by a rotary cam lock assembly. The buffer assembly contains a piston which is acted upon at the limit of recoil by viscous dampening forces, air spring forces, and mechanical spring forces in order to arrest the motion of the operating parts. This low restitution system coupled with the long, soft recoil of the weapon has resulted in greatly reduced recoil as observed by gunnery personnel and instrumental test results.

As previously mentioned, conventional single gas system, high resituttion, high rate mechanisms inpart eccentric loads of high magnitude upon the operating components and anchor points of the receiver element which result in high force transfer to the gunner (on the order of 500 to 1200 peak lbs) resulting in reduced controllability and reduced subcomponent and receiver life.

The weapon system of the present invention has a dual gas system which halves the load imparted to any individual component and provides two separate and independent power channels evenly spaced about the gun barrel to achieve symmetrical thrust. This uniform thrust shrouds the working elements of the mechanism and mounting points thereby eliminating eccentric load application to component subassemblies and exterior mounting elements. The long/soft recoil cycle in combination with the low restitution hydropneumatic buffer assembly reduces the rate of fire and loads applied to the gunner for improved controllability and receiver/subcomponent part life. Illustratively, the inventive system has achieved typical firing rates of less than 500 rounds per minute and less than 200 pounds of recoil force through the buttstock. The simplistic conceptual and modular design reduces manufacturing and life cycle maintenance costs over conventional systems, because lower internal working forces mean less stress and longer service life of parts and less parts mean lower costs of manufacture and maintenance.

BRIEF DESCRIPTION OF DRAWINGS

A more detailed and comprehensive description now follows with reference to the drawings wherein:

FIG. 2 is a plan view.

FIG. 6 is a sectional side elevational view.

DESCRIPTION OF PREFERRED EMBODIMENT

Figure 1:
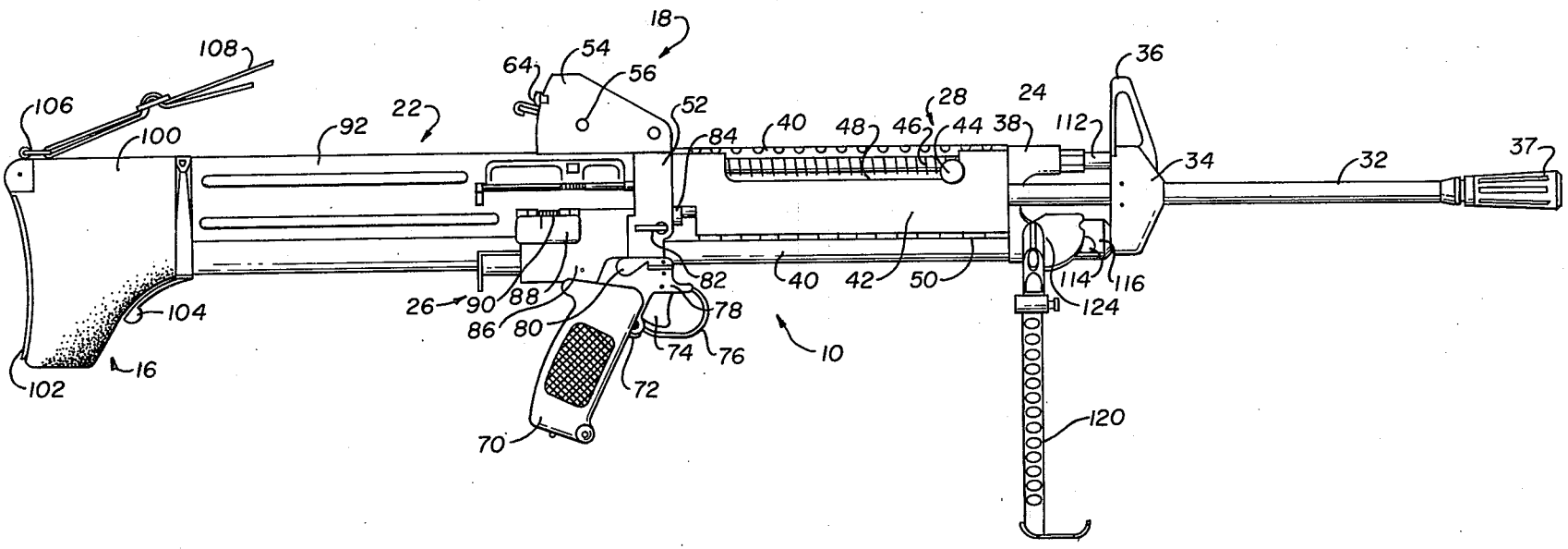
FIG. 1 is an elevational view of the weapon.
Figure 1:
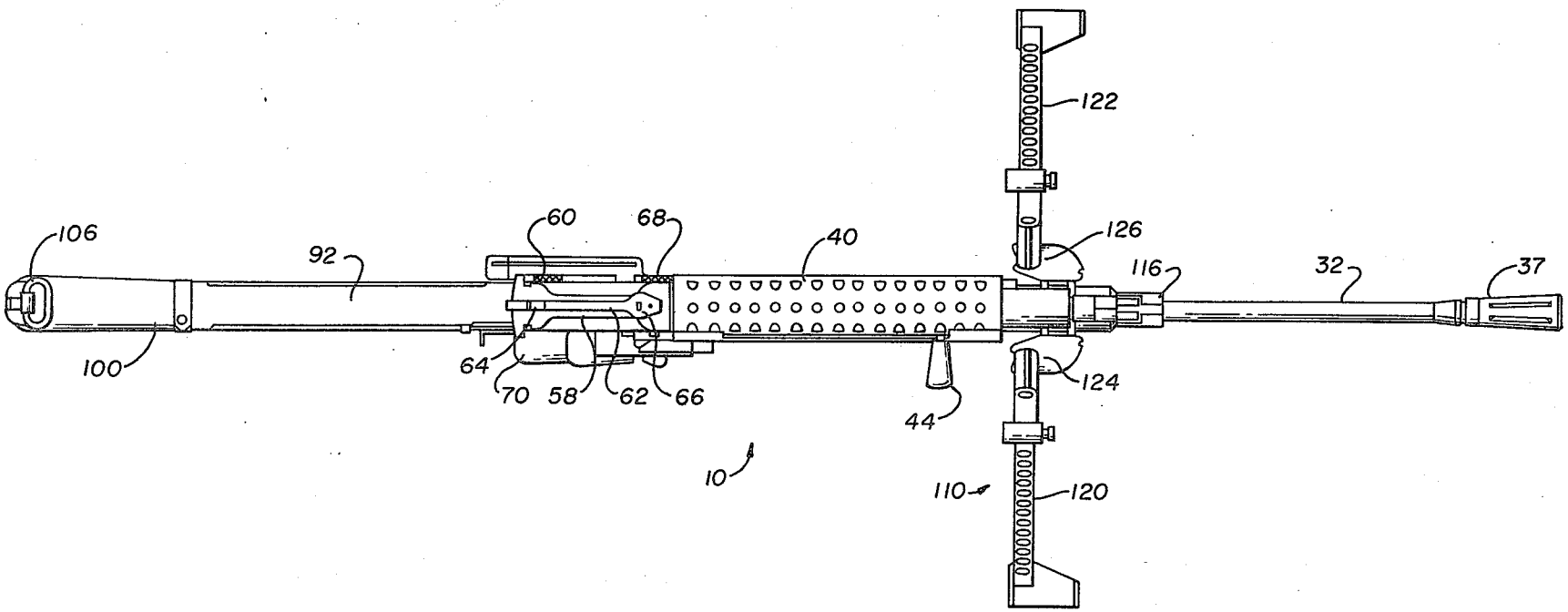
Figure 3:
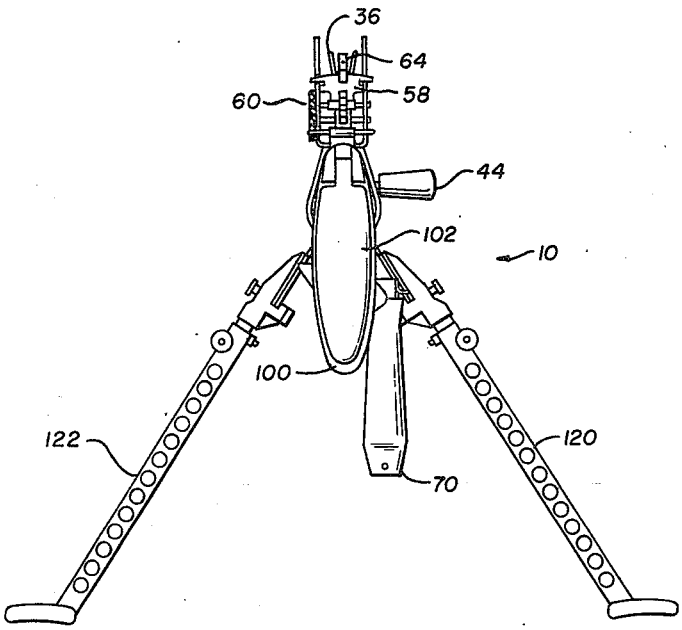
FIG. 3 is a rear end view.
Figure 4:
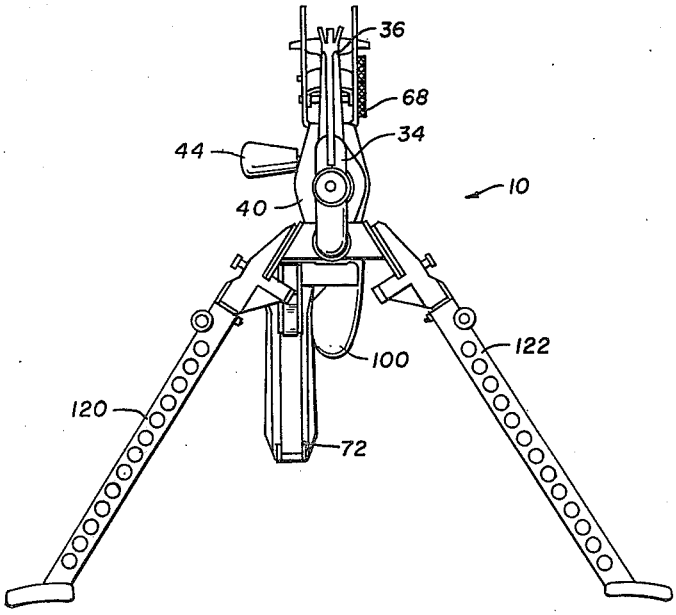
FIG. 4 is a front end view.

Referring now to the drawings there is shown in FIGS. 1–4 a lightweight, air-cooled, gas operated, linked belt/magazine fed machine gun 10 designed for low rate automatic fire. This gun consists of barrel assembly 12, foregrip assembly 14, buttstock assembly 16, aiming sight assembly 18, fire control assembly 20 and dust cover assembly 22. Internally, the gun 10 includes a receiver assembly 24, an operating group 26, charger 28 and feed mechanism 30 as can be seen in FIGS. 5 and 6.

As can be seen in FIGS. 1–4 the exposed parts of the barrel assembly 12 include the barrel 32 which extends both forwardly and rearwardly from a gas housing 34 having a front sight 36 integrally mounted on the top. The forward end of the barrel 32 terminates in a flash suppressor 37 of any convenient form known in the prior art. The rear end of barrel 32 is hidden from view by the front tube guide 38 of the receiver assembly 24 and heat shield 40 and door 42 of the foregrip assembly 14. Charger knob 44 is urged forwardly by charger return spring 46 in cut-out portion 48 of door 42 which is hingedly mounted at its lower edge 50 to heat shield 40.

Rearwardly of heat shield 40 is a bracket connection or support in the form of main end cap 52 on top of which aiming sight assembly 18 may conveniently be mounted. This assembly has a sight base 54 on which is pivotally mounted at 56 an elevation base 58 which is adjustably positionable by elevation knob 60. An azimuth base 62, bearing the rear sight 64, is laterally pivotable at 66 and is adjustable in azimuth by windage knob 68.

Below the main end cap and removably attached to it is the fire control assembly 20 having a hand grip 70, grip guard cover 72, trigger 74, trigger guard 76, free control housing 78 and safety latch 80. On the side of the main end cap 52 is a barrel latch handle 82 for fastening barrel extension 84 on the inner end of barrel 32 to the main end cap 52.

Rearwardly of main end cap 52 is the feed mechanism housing 86 having a link ejection door 88 biased by spring 90. Cartridge links are ejected through this door after each of their associated rounds has been sequentially chambered.

The dust cover 22 consists of a shell 92 sheet metal construction and serves to protect the operating parts. It contains a cartridge ejection port 94 and port dust cover 96 biased by spring 98. This dust cover 22 typically would be part of the receiver in a prior art weapon system but in the present embodiment it serves only as a protective housing.

The buttstock assembly 16 comprises a buttstock 100 housing a hydropneumatic buffer and contains a folding buttplate 102 and a storage space for spare parts. A cam lock handle 104 on the buttstock 100 is used to assemble and disassemble it as a modular subassembly. Attached to the buttstock 100 is a swivel 106 for anchoring a sling 108.

As an option bipod leg assembly 110 may be added at the time the gun barrel assembly 12 is connected to the main end cap 52, and the gas housing 34 is positioned against the gas cylinders 112, 114. This assembly has a gun connector 116 which fits over the lower gas cylinder 114 as a means of attaching the assembly to the gun. Extending from this connector is a bipod mounting 118 from which legs 120, 122 are hingedly mounted at 124, 126. These legs may be placed in fully retracted, up positions while carrying the weapon or in the down position for prone firing.

Figure 5A:
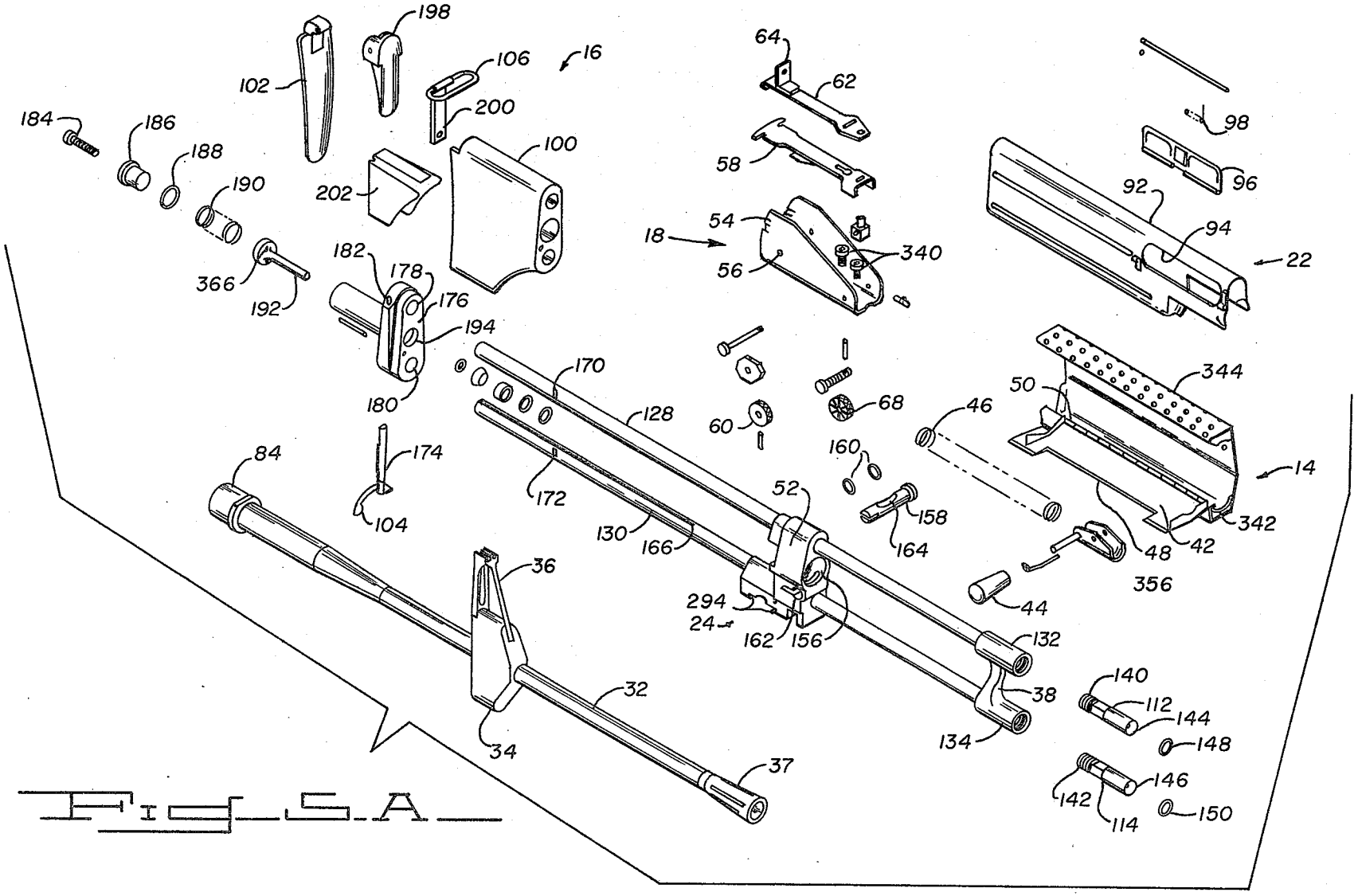
FIGS. 5A and 5B are exploded views taken in perspective.
Figure 5:
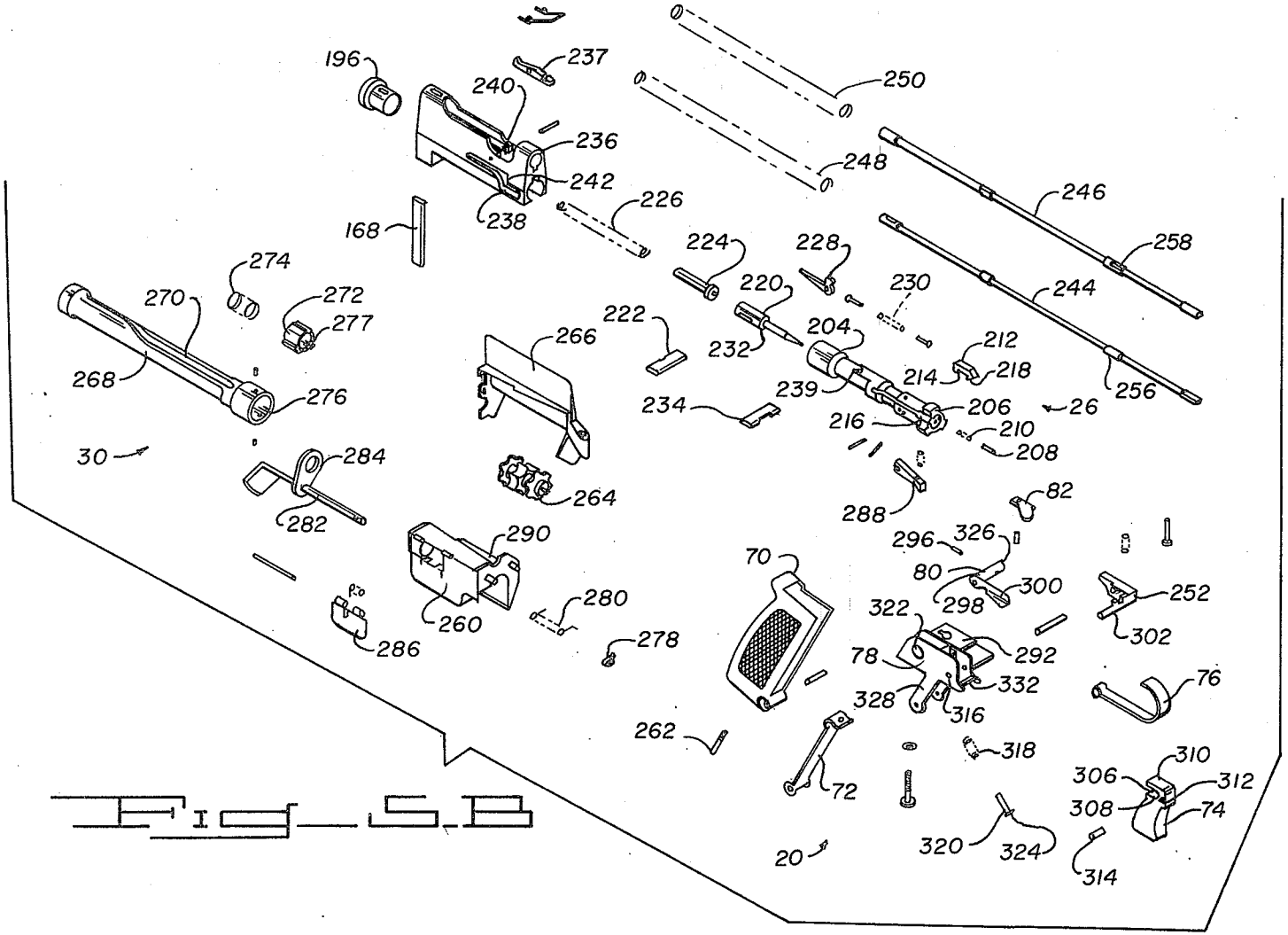
Figure 1:
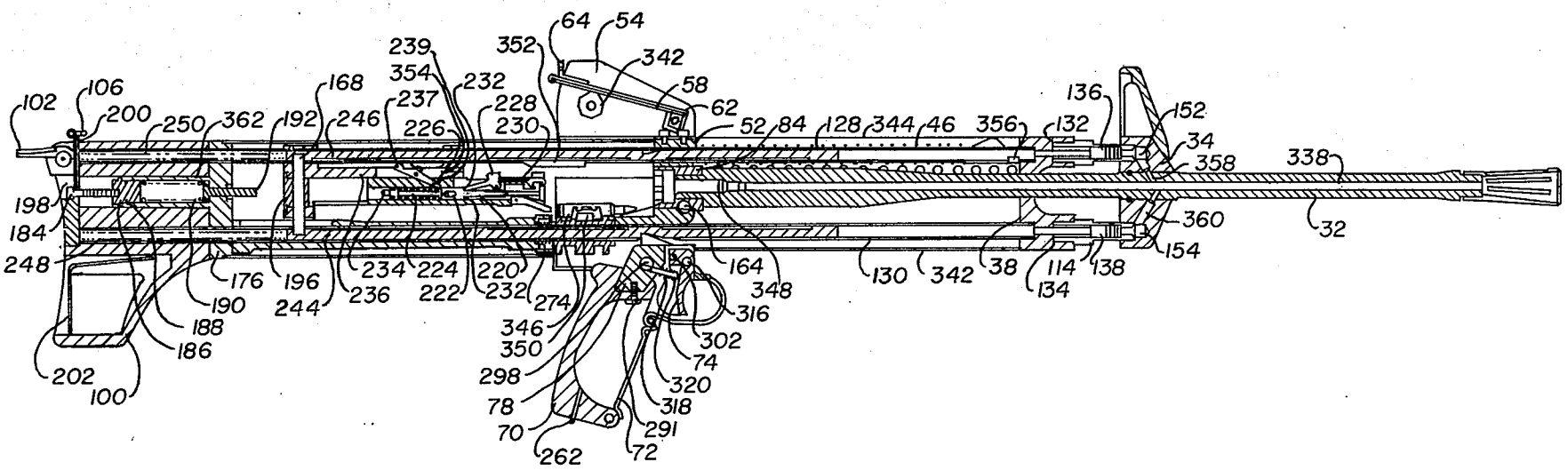

A more detailed discussion and description of the various parts will now be had with reference to the exploded view in FIGS. 5A and 5B. Here it can be seen that receiver 24 consists of two elongated, substantially parallel spaced-apart hollow cylindrical tubes 128, 130 held in spaced relationship by front tube guide 38 and main end cap 52. The front tube guide has a pair of internally threaded connectors 132, 134 which receive pistons 136, 138, and ends 140, 142 of gas cylinders 112, 114 therein. The other ends 144, 146 are sealed gas tight with gas rings 148, 150 in bores (152 and 154 in FIG. 6) in gas housing 34 on barrel 32 where gas ejecting a projectile also will move pistons 136, 138 rearwardly as will be explained hereinafter.

Barrel extension 84 fits within opening 156 in main end cap 52. A barrel latch pin 158, handle 82 and Belleville springs 160 rotate within aperture 162 in main end cap 52 to lock the extension 84 to the main end cap 52. Recess 164 in latch pin 158 is flush with opening 156 when extension 84 passes over it upon insertion. However, rotation of pin 158 by latch handle 82 engages the pin 158 in a groove (166 in FIG. 6) transverse of the underside of barrel extension 84 to lock it in place.

Carrier tubes 128, 130 have longitudinal slots 166 therein to receive drive pin 168 in the operating group 26 as will be explained hereinafter. They also have transverse outside grooves 170 to receive a cam lock rod 174 of the buttstock assembly 16 in attaching buttstock 100 to the receiver 24.

Buttstock assembly 16 includes a buttplate assembly 176 having apertures 178, 180 for insertion over the rear ends of tubes 128, 130. A vertical bore 182 communicates with these apertures and contains the cam lock rod 174 which may be rotated by handle 104. When rotated to locked position, a portion of rod 174 is received in notches 170, 172 to prevent withdrawal of the end cap assembly from the receiver.

Rearward of buttplate assembly 176 is fastening screw 184, buffer end cap 186, o-ring 188, buffer spring 190, and buffer plunger 192. This plunger 192 passes through opening 194, in end cap assembly 176 to receive and dampen recoil forces from buffer stop block 196 in operating group 26. Plunger scraper, washer, fasteners and o-rings are provided at opening 194 to prevent escape of hydraulic fluid and gases and to preclude entry of foregin material into buffer housing 176. Screw 184 also serves as a fastener for buttplate hinge 198 and swivel mount 200. Buttplate 102 pivots up on hinge 198 for prone firing as desired. Retainer 202 fits into a cavity in buttstock 100 to house cleaning tools and other small items.

The operating group 26 includes a bolt 204 having a three-lug rotating locking head 206 that fits and locks into barrel extension 84 during the firing cycle. Contained within the bolt is an ejector 208 which is captured in an assembly with an ejector spring 210. An extractor 212 is positioned diametrically opposite ejector 208 and is retained in position by a hook portion 214 over a flange 216 on the bolt. The extractor is biased to extract spent cartridges with its lip 218 after firing while the ejector 208 flips the cartridge from the gun.

Contained within interior cylindrical recesses within bolt 204 is the firing mechanism comprising firing pin 220, the firing pin cocking pin 222, firing pin spring guide and follower 224 and firing pin spring 226. Firing pin sear 228 retains the firing pin 220 in its rearward or cocked position by dropping down under the influence of extractor and sear spring 230 in front of shoulder 232 on the firing pin 220. Bolt cam pin 234 locks the assembly and fits within a curved slot (hidden from view) in bolt carrier 236. As this pin moves longitudinally in the slot it rotates bolt 204 to lock and unlock the bolt locking head 206 in barrel extension 84. While this action is taking place, the firing pin cocking pin 222 rides in cocking slots 238, 240 on opposed sides of carrier 236. During recoil the firing pin cocking pin 222 engages abutting shoulders 242 in slots 238, 240.

Bolt carrier 236 is fastened by drive pin 168 to elongate force-transmitting means in the form of operating rods 244, 246 which slide within tubes 128, 130 of carrier 24 where they are urged forwardly by biasing force means such as main drive springs 248, 250. When a cartridge is fired, gases move pistons 136, 138 rearward with such force as to drive these rods 244, 246 rearward. There they are held rearwardly by sear 252 which is pivotally mounted to main end cap 52 and biased in such retention position by spring 254 so as to engage notch 256 on lower rod 244. This notch is identical with notch 258 on upper rod 246, making the rods identical and interchangeable. The bolt sear 237 is pivotally mounted in the bolt carrier 236 and engages bolt recess 239 during recoil and counterrecoil to keep the bolt extended and to prevent premature rotation of the bolt prior to the locking cycle.

Cartridges are fed into the gun on a linked belt from a magazine, not shown, that clips onto the left hand side of the feed housing 260 and also attaches onto a detenting pin 262 on the bottom of hand grip 70. Sprocket 264 receives the first cartridge and link. This sprocket is rotatably mounted on lower tube 130 of the carrier 24 and is confined in feed housing 260 which also fits over tube 130. Feed tray cover 266 pivots from the main end cap 52 for loading, and when closed and latched provides guidance for incoming cartridges over the sprocket 264. This sprocket is unique in that it has 3 rows of teeth, two narrow rows and a center wide row. The fore and aft teeth provide cartridge control so that the cartridge does not cant as it is rotated into full feed position. The wider center row knifes into the void between link/cartridge assemblies to provide control of the link during the cartridge forward stripping process. It also provides the forcing element which ejects the spent link from the weapon during subsequent feeding action.

Sprocket 264 is rotated during the recoiling cycle of the operating group 26 during which drive pin 168 moves rearwardly in slot 166 of lower rod 130. A feed cam tube 268 also fits over receiver tube 130 and has a cycloidal slot 270 in it in which drive pin 168 also travels. This rearward movement of pin 168 in slot 160 of tube 130 thus causes rotation of feed cam tube 268 in a clockwise direction looking forwardly from the buttstock. A sprocket drive ratchet 272 urged by spring 274 fits into the front end 276 of tube 268 and engages ratchet teeth (not shown) on the rear end of sprocket 264. Upon counterrecoil of the operating group 26, in which drive pin 168 moves forward and drives feed cam tube 268 in a counterclockwise direction, the ratchet teeth 277 slip over the ratchet teeth (not shown) on sprocket 264. During counter recoil the sprocket is kept from reversing by a sprocket release paul 278 which is loaded by spring 280 and mounted on ratchet release pin 282. This pin is part of ratchet release 284 which, when manually retracted, disengages the pawl 278, the feed tray cover 266 and ratchet drive 272. This frees the sprocket 264 for counterrotation and accessibility for unloading or reloading.

A link port door 286 is pivotally mounted on feed housing 260. These links are freed when their associated cartridges are stripped by forward movement of bolt 204. This bolt has a rammer 288 which moves the cartridge up a guide ramp 290 on feed housing 260 and into the chamber recess of barrel 32, during subsequent recoil. It should be noted that when the cartridge is positioned for stripping the diverging feed tray and guide ramp 290 has caused an upward tipping of the cartridge and link assembly in such a fashion that the cartridge is on a direct line path to the chamber. This differs from conventional feed systems where the cartridge is positioned parallel to the chamber centerline and where the cartridge must move parallel in stripping until such time as it has cleared the link assembly and then migrate rapidly into the chamber area and again assume a parallel position before insertion into the chamber. This sprocket, diverging feed tray and guide ramp combination allows for positive prepositioning of the cartridge such that the stripping process can be accomplished in conjunction with direct line advance of the cartridge to the chamber. This permits closer positioning of feed components to the breech, provides better cartridge feed control, reduces conventional receiver length and malfunction potential.

The fire control assembly 20 consists of a housing 78, hand grip 70, grip guard cover 72, trigger guard 76, and trigger 74. This assembly is mounted on main end cap 52, but is offset to the right of the longitudinal center of gravity to facilitate ease of handling and operation. Housing 78 has a mounting plate 292, that fits into slots 294, in main end cap 52, when assembled. Safety latch 80, has a pin 296, on shank 298, that rides in a groove (not shown) in main end cap 52, to lock the fire control assembly 20, to the receiver 24 when the latch handle 300 is at fire position F, or safety position S as marked on fire housing 78. Crank arm 302 of sear 252 is inserted into opening 304 of housing 78, where it is received in groove 306 defined by jaws 308, 310 of trigger 74. This trigger is pivoted at aperture 312 on pin 314 in apertures 316 in housing 78. A trigger spring 318 and spring retaining pin 320 fit into bore 322 in housing 78. The outer end 324 engages trigger 74 and moves rearward as the trigger is squeezed. However, when latch handle 300 is depressed down to its safety position S, movement of pin 320 is prevented and trigger 74 cannot be depressed. This is because shaft 298 has a half-moon configuration and the path of the pin is through the open space when the latch is in fire position F and is blocked by the shaft when in safety position. Shaft 298 has a flat configuration on its end 326 such that in safety position S, it abuts sear 252 to prevent its downward movement from engagement with operating rod 244.

The trigger guard 76 is pivotally mounted to legs 328 of fire control housing 78 with its outer end 330 in friction contact with front end 332 of housing 78. Grip guard cover 78 is pivotally mounted at 334 on handle 70 and its upper end 336 frictionally engages housing legs 328. When use of the trigger guard 76 is not desired, such as when the operator is wearing mittons, the upper end 336 of grip guard cover 72 is pulled forward. The trigger guard is pulled downwardly and rearwardly to nest within the hand grip 70. Thereafter the guard cover is rotated back into position and the gun is ready for use without the trigger guard 76.

Reference is now made to FIG. 6, showing in sectional view the various modules and subassemblies in operating condition. Here is shown the receiver 24 consisting with its dual tubes 128, 130 held by front tube guide 38 and main end cap 52. Barrel assembly 12 has its barrel extension 84 contained within the main end cap 52 and the barrel gas housing 34 is positioned over the gas cylinders 112, 114 which are threaded onto connectors 132, 134 of front tube guide 38. Here it can be seen that bores 152, 154 within housing 34 communicate between gun bore 388 and the gas cylinders 112, 114 to supply gases from a spent cartridge to pistons 136, 138 to propel the operating parts rearwardly.

The sight group 18 is mounted by screws 340 to main end cap 52. The elevation base 58 rests on elevation cam 342 which rotates about pivot 56 for desired elevation sighting.

Both the feed mechanism 30 and the operating group 26 are positioned over the receiver tubes 128, 130 before the dust cover 22 and buttstock assembly 16 are added. The foregrip assembly 14 and fire control assembly 20 may be added and removed in any sequence since they do not depend upon installation or removal of the parts in their assembly and removal. The foregrip assembly 14 is installed by placing the lower portion 342 under the lower receiver tube 130 and springing the top portion 344 over the top receiver tube 138. Door 42 is spring loaded and pivots up to closed position.

The operating group 26 is shown in its cocked or rearward position. This is effected by pulling back the charger knob 44 in FIG. 5A. This moves charger bracket 356 against operating rod 256 and pushes it rearwardly until sear 252 engages notch 256 of lower operating rod 244. A round of ammunition 346 is positioned on sprocket 264, on guide ramp 290 and rearwardly of its firing position in chamber 348 in barrel 32. This round or cartridge 346 is still retained in its belt by belt link 350. The open bolt position thus described is customary in machine gun design to avoid safety problems associated with having a cartridge placed in a hot chamber for a period of time before firing and having it fire (heated by previous firing) due to premature cook-off caused by the high level of retained heat in the breech.

The operating group 26 is held in its cocked or rearward position against the resistance of drive springs 248, 250 by engagement of sear 252 in notch 256 of lower operating rod 244 in lower receiver tube 130. In cocked position, rammer 288 on bolt 204 is rearward of cartridge 346, ready to ram the cartridge up ramp 290, free from its belt link 350 and into chamber 348.

In the operating group rearward position, as shown, the bolt 204 and bolt carrier 236 are elongated. That is, the carrier has moved further rearwardly than the bolt and spring urged bolt sear 237 has engaged recess 239 in bolt 204. This is in order to maintain the bolt in a forward extended position so that in firing the rammer 288 will load the cartridge into chamber 348 and the three lugs 206 on the bolt 204 will align with the pass through the three slots in the bolt locking head 206 in barrel extension 84 before rotating and locking. (Rotation is caused by bolt cam pin 234 riding in a slot 240 in bolt carrier 236).

When the bolt 204 has moved forward and become locked with the barrel extension 84, the bolt sear 237 is tripped by ramp 352 which is attached under the upper carrier tube 128. This permits the bolt carriage 236 to continue its forward movement until bolt 204 has been locked, and thus release firing pin 220 to strike the chambered cartridge 346. When shoulder 354 on bolt carrier 236 moves forward and strikes sear 228, the sear is freed from shoulder 232 of firing pin 220 which is spring urged by spring 226 to move forward to strike the cartridge.

As the bullet passes orifices 358, 360, and bores 152, 154 in gas housing 34, gases propelling the spent bullet cause pistons 136, 138 to ram operating rods 244, 246 rearwardly with more than enough force to move notch 256 in lower operating rod 244 rearwardly beyond sear 252. As the bolt carrier 236 moves back, bolt cam pin 234 rides a slot in the carrier to rotate the bolt 204 to free it from barrel extension 84. Lip 218 on extractor 212 pulls out the spent cartridge case and ejector pin 208 flings it out of the gun.

As the bolt carrier 236 moves back, buffer stop block 196 in operating group 26 strikes buffer plunger 192 in the buffer assembly in the buttstock group. This hydropneumatic buffer assembly acts in three ways to bring the high velocity operating group 26 from its rearward movement to rest. A carefully measured charge of hydraulic fluid and air in cylinder 362 of the end of cap assembly 176 is compressed by the plunger piston 364 as the plunger 192 is thrust rearward. This fluid resists rearward motion of the operating group 26 as it is metered through piston orifices 366 in piston 364. Secondly, the gaseous air which is trapped in the buffer housing cylinder 362 is compressed by the addition of the volume of plunger shaft 192 that has been caused to extend into the housing. This generates an increased pressure acting as an area equivalent to the cross-section of plunger 192. Thirdly, the plunger return spring 190 provides some mechanical resistance to this rearward motion. These three buffering effects act in combination with the main drive springs 248, 250 to slowly arrest all rearward motion of the operating group 26. This combined effect increases the time involved in buffering over conventional systems by as much as 600%; reduces the associated load applied to the receiver and the gunner of gun mount by as much as 80–90%. The natural rate of fire of the mechanism has also been reduced by approximately 35%. The compressed piston return spring 190 has only sufficient energy to return the plunger into its fully forward position in time for the next buffering cycle.

On return, the forward movement of the operating group 26 stops when sear 252 engages groove 256 in lower operating rod 244 and the gun remains in cocked position, ready for the squeeze of trigger 74 to start operating again.

The gun is placed on safety when safety latch 80 (shown in FIG. 5B) is depressed and shank 298 is rotated. This rotates its half-moon configuration into the path where the trigger spring retaining pin 320 is depressed by trigger 74 and thus prevents movement of the trigger. Shank 298 also has an end 326 with a projection that keeps sear 252 in groove 256 as a second or double safety feature.

It should be noted that the dust cover assembly has no operational function and may be removed at any time without hindering weapon function. This makes it possible to take high speed movies of the operating parts to rapidly correct any developemental or manufacturing problem areas.

While the present invention has been described in one illustrative embodiment, obviously other embodiments will occur to one skilled in the art and it is to be understood that any such deviations or modifications of the embodiment just described are to be considered as part of the present invention as defined by the claims.

What is claimed is:

1. A gas operated gun, comprising:

a gun barrel adapted to contain a gas under pressure for propelling a projectile through said barrel, a receiver having a pair of elongated, substantially parallel hollow tubes, said receiver further having bracket means connected to each of said tubes for securing said tubes fixedly in spaced-apart relationship and also for securing said gun barrel between said tubes, elongated force-transmitting means including operating rods longitudinally moveable within each of said tubes, gas cylinder means connected between said gun barrel and said force-transmitting means, for applying force generated from said gas under pressure to said force-transmitting means, a cartridge feeding mechanism rotatably mounted on one of said tubes and a bolt carrier slidably mounted on the other tube, and a main drive pin inter-connecting said rods, said tubes having slots therein along which said drive pin rides in response to gas pressure applied to said operating rods, said drive pin being operatively connected to said cartridge feeding mechanism and to said bolt carrier.

2. A gas operated gun as set forth in claim 1 wherein said cartridge feeding mechanism includes a feed cam tube with an arcuate slot therein, said feed cam tube being rotatably mounted on one of said receiver tubes, said drive pin extending into said arcuate slot and thereby rotating said cam tube as said drive pin moves along said slots in response to gas pressure applied to said operating rods.

3. A gas operated gun as set forth in claim 2 wherein said cartridge feeding mechanism includes a feed sprocket rotatably mounted on one of said receiver tubes, and rotating means between said sprocket and said feed cam tube for rotating said sprocket undirectionally.

4. A gas operated gun as set forth in claim 3 including release means for overriding said rotating means to permit bidirectional rotation of said sprocket.

5. A gas operated gun as set forth in claim 3 including a cartridge chamber in said barrel and wherein said sprocket is contained within a feed housing having a guide ramp therein for positioning cartridges while still in links and on said sprocket in a direction angularly oriented relative to said cartridge chamber in said barrel.

6. A gas operated gun as set forth in claim 3 wherein said sprocket has end rows of teeth to stabilize a cartridge thereon and an intermediate third row of teeth to retain the stabilized cartridge link during forward stripping of said cartridge therefrom.

7. A modular lightweight automatic weapon system including:

a receiver having dual tubes spaced apart and connected by a main end cap and a forward tube guide, a barrel having a barrel extension held by said main end cap and a gas housing connected to said front tube guide, said barrel having a bore through which a fired cartridge passes, said gas housing having orifices interconnecting said bore and said forward tube guide, operating rods slidably mounted witin said tubes and having a bolt carrier carried thereby, said bolt carrier being operable when moved forwardly to move a cartridge into said barrel extension and maintain itself therebehind until said cartridge is fired, said operating rods being actionable by gases in said bore to move said bolt carrier rearwardly for ejection of spent cartridge cases, and means indexing another cartridge in position for movement into said barrel extension upon subsequent forward movement of said bolt carrier.

8. A modular lightweight automatic weapon system as set forth in claim 7 wherein gas cylinders interconnect said gas housing with said tubes and have pistons therein, said pistons being operable by said gases to move said operating rods and bolt carrier rearwardly on said receiver tubes.

9. A modular lightweight automatic weapon system as set forth in claim 8 including counterrecoil springs in said tubes to move said bolt carrier forwardly after rearward motion of said bolt carrier has been terminated.

10. A modular lightweight automatic weapon system as set forth in claim 8 wherein a buttstock assembly is fastened to the ends of said receiver tubes, said buttstock assembly having a hydropneumatic buffer to absorb recoil forces when said bolt carrier moves rearwardly.

11. A gas operated gun, comprising:

a gun barrel adapted to contain a gas under pressure for propelling a projectile through said barrel, a receiver having a pair of elongated, substantially parallel hollow tubes, said receiver further having bracket means connected to each of said tubes for securing said tubes fixedly in spaced-apart relationship and also for securing said gun barrel between said tubes, elongated force-transmitting means within each of said tubes, gas cylinder means connected between said gun barrel and said force-transmitting means, for applying force generated from said gas under pressure to said force-transmitting means, a main drive connected to each of said force-transmitting means for movement therewith, a bolt carrier slidably mounted on one of said tubes and movable with said main drive, a cartridge feed mechanism rotatably mounted on the other of said tubes, said main drive being operatively connected to said feed mechanism to cause rotation thereof upon movement of said drive.

* * * * *